US010550355B2

(12) United States Patent
Kleine et al.

(10) Patent No.: US 10,550,355 B2
(45) Date of Patent: Feb. 4, 2020

(54) LONG LASTING CLEANING FOAM

(71) Applicant: ECOLAB USA INC., St. Paul, MN (US)

(72) Inventors: Tillmann Kleine, Köln (DE); Michael Schmidt, Mönchengladbach (DE); Gunnar Nöding, Bensheim (DE); Daniela Richter, Düsseldorf (DE); Christine Fehlis, Langenfeld (DE); Virginie Maas, Kempen (DE); Claudia Caussin De Schneck, Düsseldorf (DE)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/543,324

(22) PCT Filed: Jan. 15, 2015

(86) PCT No.: PCT/EP2015/050686

§ 371 (c)(1),
(2) Date: Jul. 13, 2017

(87) PCT Pub. No.: WO2016/112984

PCT Pub. Date: Jul. 21, 2016

(65) Prior Publication Data

US 2018/0002634 A1 Jan. 4, 2018

(51) Int. Cl.

| | |
|---|---|
| ***C11D 1/75*** | (2006.01) |
| ***C11D 1/83*** | (2006.01) |
| ***C11D 1/06*** | (2006.01) |
| ***C11D 1/29*** | (2006.01) |
| ***C11D 3/04*** | (2006.01) |
| ***C11D 11/00*** | (2006.01) |

(52) U.S. Cl.

CPC ..... *C11D 1/83* (2013.01); *C11D 1/06* (2013.01); *C11D 1/29* (2013.01); *C11D 1/75* (2013.01); *C11D 3/044* (2013.01); *C11D 11/0023* (2013.01)

(58) Field of Classification Search

CPC ..... C11D 1/83; C11D 1/75
USPC ..... 510/426, 503
See application file for complete search history.

(56) References Cited

U.S. PATENT DOCUMENTS

| | | | | |
|---|---|---|---|---|
| 3,086,943 A | | 4/1963 | Lang | |
| 4,070,309 A | | 1/1978 | Jacobsen | |
| 4,133,779 A | | 1/1979 | Hellyer et al. | |
| 5,230,823 A | | 7/1993 | Wise et al. | |
| 5,922,672 A | * | 7/1999 | Stringer | C11D 17/0021 510/101 |
| 2012/0225943 A1 | * | 9/2012 | Gohl | A01N 41/04 514/558 |
| 2013/0096045 A1 | | 4/2013 | Sun et al. | |
| 2014/0238445 A1 | * | 8/2014 | Stokes | C11D 3/48 134/28 |

FOREIGN PATENT DOCUMENTS

| | | | |
|---|---|---|---|
| DE | 1 150 781 | B | 6/1963 |
| EP | 0 021 545 | A1 | 1/1981 |
| GB | 1 458 783 | A | 12/1976 |
| GB | 1 524 441 | A | 9/1978 |
| JP | 51-16306 | A | 2/1976 |
| JP | 51-125405 | A | 11/1976 |
| JP | 56-38397 | A | 4/1981 |
| JP | 6-501730 | A | 2/1994 |
| JP | 6-502884 | A | 3/1994 |
| JP | 6-505032 | A | 6/1994 |
| WO | 92/06156 | A1 | 4/1992 |
| WO | 92/06157 | A1 | 4/1992 |
| WO | 92/08777 | A1 | 5/1992 |
| WO | 94/09100 | A1 | 4/1994 |
| WO | 97/12022 | A1 | 4/1997 |
| WO | 97/12027 | A1 | 4/1997 |
| WO | 2013/110551 | A1 | 8/2013 |

OTHER PUBLICATIONS

International Search Report and Written Opinion of the International Searching Authority for corresponding International Patent Application No. PCT/EP2015/050686 dated Sep. 22, 2015, 10 pages.

* cited by examiner

*Primary Examiner* — Gregory E Webb
(74) *Attorney, Agent, or Firm* — Merchant & Gould P.C.

(57) ABSTRACT

The invention relates to an aqueous foaming cleaning composition for removing soil at low temperatures from a surface to be cleaned, characterized in, that the aqueous foaming cleaning composition comprises: a linear and/or branched $C_{12}$-alkyl dimethylamine oxide or $C_{12}$-alkyl diethylamine oxide or $C_{12}$-alkyl methylethylamine oxide; a linear and/or branched $C_{14}$-alkyl dimethylamine oxide or $C_{14}$-alkyl diethylamine oxide or $C_{14}$-alkyl methylethylamine oxide; at least one anion tenside of: a dodecyl (oxyethylen)w sulfat, wherein w represents an average addition mole number ranging from about 1 to about 10, and/or at least one polyoxyalkylene alkyl ether carboxylic acid or salt thereof represented by formula (I): $RO\text{-}(AO)_{n-1}\text{-}A'\text{-}COO_mM$ (I) wherein, R represents a linear and/or branched alkyl group having about 8 to about 18 carbon atoms; AO represents an alkylene oxy group having about 2 to about 4 carbon atoms; n represents an average addition mole number ranging from about 1 to about 20; A' represents an alkylene group having about 1 to about 3 carbon atoms; M represents H or a cation; and m represents the number equal to a valence number of M; —a source of alkalinity; and —water.

13 Claims, No Drawings

LONG LASTING CLEANING FOAM

This application is a National Stage Application of PCT/EP2015/050686, filed 15 Jan. 2015, and which application is incorporated herein by reference. To the extent appropriate, a claim of priority is made to the above disclosed application.

FIELD OF THE INVENTION

The present invention relates to surface cleaning foam compositions having improved foam characteristics and increased dwell time, a method of manufacture and the use thereof.

BACKGROUND OF THE INVENTION

In many industrial applications, such as the manufacture of foods and beverages, especially in the meat processing industry, hard surfaces commonly become contaminated with soils such as carbohydrate, proteins, blood and water hardness soils, food oil soils, fat soils and other soils. Such soils can arise from the manufacture of both liquid and solid foodstuffs. Meat soils and residues such as proteins, fats, blood and oils, especially when dried, can be hard to remove soil. Similarly, carbohydrate soils, such as cellulosic, monosaccharides, disaccharides, oligosaccharides, starches, gums and other complex materials, when dried, can form tough, hard to remove soils, particularly when combined with other soil components such as proteins, blood, fats, oils, minerals, and others. The removal of such food soil, such as meat soils and residues, can be a significant problem.

Clean out of place systems (COP) cleaning techniques are a specific cleaning regimen adapted for removing soils from exterior surfaces of a wide variety of parts, such as ceramic surfaces, metal surfaces, walls, wash tanks, soaking vessels, mop buckets, holding tanks, scrub sinks, vehicle parts washers, non-continuous batch washers and systems, ceilings, external parts of production machinery and the like.

Often clean out of place methods can involve a first rinse, the application of the cleaning solutions, and a second rinse with potable water followed by resumed operations. The process can also include any other contacting step in which a rinse, acidic or basic functional fluid, solvent or other cleaning component such as hot water, cold water, etc. can be contacted with the equipment at any step during the process. Conventional clean in place as well as clean out of place methods require high temperatures, up to about 80° C. In production rooms, the elevated water temperature currently used for that kind of cleaning processes is in the range of about 40° C. to about 60° C. Conventional clean out of place techniques (COP) thus require the consumption of large amounts of energy.

Further cleaning compositions used in clean out of place processes, in particular in the food and meat processing industry are no-foaming or low foaming liquid compositions. No-foaming or low foaming cleaning compositions have the drawback that the dwell time or so called "soaking time" on an upright tiled wall is short due to a good flow rate of the liquid cleaning composition.

Furthermore, no-foaming or low foaming cleaning compositions have the drawback that the user cannot easily track the areas that are processed or not processed due to the brief residence time of the cleaning composition and low foam stability. There is a tendency that surfaces to be cleaned are treated twice thus require the consumption of large amounts of water and cleaning composition.

What is needed therefore is an improved cleaning composition for removing soils having increased foam stability at lower temperatures, an increased dwell time and being traceable.

SUMMARY OF THE INVENTION

The object addressed by the present invention is to provide a long lasting cleaning composition that has excellent soil removal properties at lower temperatures, increased foam stability, increased dwell time and being traceable, that can be used for example in the food and meat processing industry.

According to one aspect an aqueous foaming cleaning composition for removing of soil at low temperatures from a surface to be cleaned is provided, wherein the aqueous foaming cleaning composition comprises:

- a linear and/or branched $C_{12}$-alkyl dimethylamine oxide or $C_{12}$-alkyl diethylamine oxide or $C_{12}$-alkyl methylethylamine oxide, wherein $C_{12}$-alkyl dimethylamine oxide is preferred;
- a linear and/or branched $C_{14}$-alkyl dimethylamine oxide or $C_{14}$-alkyl diethylamine oxide or $C_{14}$-alkyl methylethylamine oxide, wherein $C_{14}$-alkyl dimethylamine oxide is preferred;
- at least one anion tenside, preferably at least two anion tensides, of:
  - a dodecyl (oxyethylen)$_w$ sulfat, wherein w represents an average addition mole number ranging from 1 to 10, and/or
  - of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

- R represents a linear and/or branched alkyl group having about 8 to about 18 carbon atoms;
- AO represents an alkylene oxy group having about 2 to about 4 carbon atoms;
- n represents an average addition mole number ranging from about 1 to about 20;
- A' represents an alkylene group having about 1 to about 3 carbon atoms;
- M represents H or a cation; and
- m represents the number equal to a valence number of M;
- a source of alkalinity; and water.

According to another aspect an aqueous foaming cleaning composition for removing of soil at low temperatures from a surface to be cleaned is provided, wherein the aqueous foaming cleaning composition may comprise:

- a linear and/or branched $C_{12}$-alkyl dimethylamine oxide,
- a linear and/or branched $C_{14}$-alkyl dimethylamine oxide;
- at least one anion tenside, preferably at least two anion tensides, of:
  - a dodecyl (oxyethylen)$_w$ sulfat, wherein w represents an average addition mole number ranging from about 2 to about 8 and more preferred about 3 to about 5, and/or
  - of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

- R represents a linear and/or branched alkyl group having about 8 to 18 about carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

a source of alkalinity;

water.

According to one aspect an aqueous foaming cleaning composition for removing of soil at low temperatures from a surface to be cleaned is provided, wherein the aqueous foaming cleaning composition comprises:

a linear and/or branched $C_{12}$-alkyl dimethylamine oxide, a linear and/or branched $C_{14}$-alkyl dimethylamine oxide;

at least one anion tenside, preferably at least two anion tensides, of:

a dodecyl (oxyethylen)$_w$ sulfat, wherein w represents an average addition mole number ranging from 1 to 10, and/or of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to about 18 carbon atoms;

AO represents an alkylene oxy group having about 2 to about 4 carbon atoms; n represents an average addition mole number ranging from about 1 to about 20;

A' represents an alkylene group having about 1 to about 3 carbon atoms;

M represents H or a cation; and m represents the number equal to a valence number of M;

a source of alkalinity;

water.

According to another aspect an aqueous foaming cleaning composition for removing of soil at low temperatures from a surface to be cleaned is provided, wherein the aqueous foaming cleaning composition may comprise:

a linear and/or branched $C_{12}$-alkyl dimethylamine oxide, a linear and/or branched $C_{14}$-alkyl dimethylamine oxide;

at least one anion tenside, preferably at least two anion tenside, of:

a dodecyl (oxyethylen)$_w$ sulfat, wherein w represents an average addition mole number ranging from about 2 to about 8 and more preferred about 3 to about 5, and/or of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to 18 about carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

a source of alkalinity;

water.

According to another aspect an aqueous foaming cleaning composition for removing of soil at low temperatures from a surface to be cleaned is provided, wherein the aqueous foaming cleaning composition may comprise:

a linear and/or branched $C_{12}$-alkyl dimethylamine oxide, a linear and/or branched $C_{14}$-alkyl dimethylamine oxide;

at least one anion tenside, preferably at least two anion tenside, of:

a dodecyl (oxyethylen)$_w$ sulfat, wherein w represents an average addition mole number ranging from about 2 to about 8 and more preferred about 3 to about 5;

a source of alkalinity;

water.

According to another aspect an aqueous foaming cleaning composition for removing of soil at low temperatures from a surface to be cleaned is provided, wherein the aqueous foaming cleaning composition may comprise:

a linear and/or branched $C_{12}$-alkyl dimethylamine oxide, a linear and/or branched $C_{14}$-alkyl dimethylamine oxide;

at least one anion tenside, preferably at least two anion tenside, of:

of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to 18 about carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

a source of alkalinity;

water.

It has been surprisingly found that the aqueous foaming cleaning composition can be used for removal of soil at reduced temperatures, while still providing excellent soil removal properties. Thus, the compositions of the present invention provide for reduced energy consumption, since it is active at lower cleaning temperatures.

The composition of the invention is applied to the surface to be cleaned in the form of a foam. The foam has compared to a liquid composition an increased dwell time and the foam treated areas can be easily tracked that avoids multiple treatment of the same area.

Furthermore, the aqueous foaming cleaning composition is active at a low components concentration thus provides a reduced chemical consumption.

According to another aspect an aqueous foaming cleaning composition is provided, wherein the weight-% ratio of the $C_{12}$-alkyl dimethylamine oxide to the $C_{14}$-alkyl dimethylamine oxide is about 10:1 to about 1:10, preferably about 5:1 to about 1:5, further preferred 4:1 to about 1:4 and in addition preferred about 3:1 to about 1:3, whereby the weight-% is based on the total weight of the composition.

According to another aspect an aqueous foaming cleaning composition is provided, wherein the weight-% ratio of the $C_{12}$-alkyl dimethylamine oxide to the $C_{14}$-alkyl dimethylamine oxide is about 5:1 to about 1:5, preferably about 4:1 to about 1:4 and in addition preferred about 3:1 to about 1:3, whereby the weight-% is based on the total weight of the composition.

According to another aspect an aqueous foaming cleaning composition is provided, wherein the aqueous foaming cleaning composition may comprise:

a linear and/or branched $C_{12}$-alkyl dimethylamine oxide,
a linear and/or branched $C_{14}$-alkyl dimethylamine oxide;
at least one anion tenside of:
a dodecyl (oxyethylen)$_w$ sulfat, wherein w represents an average addition mole number ranging from about 1 to about 10, preferably about 2 to about 8 and more preferred about 3 to about 5, and/or
of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,
R represents a linear and/or branched alkyl group having about 8 to about 18 carbon atoms, preferably about 10 to about 16 carbon atoms and more preferred about 12 to about 14 carbon atoms;
AO represents an alkylene oxy group having about 2 to about 4 carbon atoms, preferably about 2 to about 3 carbon atoms and more preferred about 2 carbon atoms;
n represents an average addition mole number ranging from about 1 to about 20, preferably about 2 to about 10 and more preferred about 3 to about 5;
A' represents an alkylene group having about 1 to about 3 carbon atoms, preferably about 2 to about 3 carbon atoms and more preferred about 2 carbon atoms;
M represents H or a cation; and
m represents the number equal to a valence number of M;
a source of alkalinity;
water; and wherein the weight-% ratio of the $C_{12}$-alkyl dimethylamine oxide to the $C_{14}$-alkyl dimethylamine oxide is about 10:1 to about 1:10, preferably about 5:1 to about 1:5, further preferred 4:1 to about 1:4 and in addition preferred about 3:1 to about 1:3.

According to another aspect an aqueous foaming cleaning composition is provided, wherein the weight-% ratio of the $C_{12}$-alkyl dimethylamine oxide to the $C_{14}$-alkyl dimethylamine oxide is preferably about 6:1 to about 1:6, further preferred 5:1 to about 1:4 and in addition preferred about 2:1 to about 1:2, whereby the weight-% is based on the total weight of the composition.

According to one aspect an aqueous foaming cleaning composition for removing of soil at low temperatures from a surface to be cleaned is provided, wherein the aqueous foaming cleaning composition may comprise:

a linear and/or branched $C_{12}$-alkyl dimethylamine oxide,
a linear and/or branched $C_{14}$-alkyl dimethylamine oxide;
at least one anion tenside of:
a dodecyl (oxyethylen)$_w$ sulfat, wherein w represents an average addition mole number ranging from about 1 to about 10, preferably about 2 to about 8 and more preferred about 3 to about 5, and/or
of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,
R represents a linear and/or branched alkyl group having about 8 to about 18 carbon atoms, preferably about 10 to about 16 carbon atoms and more preferred about 12 to about 14 carbon atoms;
AO represents an alkylene oxy group having about 2 to about 4 carbon atoms, preferably about 2 to about 3 carbon atoms and more preferred about 2 carbon atoms;
n represents an average addition mole number ranging from about 1 to about 20, preferably about 2 to about 10 and more preferred about 3 to about 5;
A' represents an alkylene group having about 1 to about 3 carbon atoms, preferably about 2 to about 3 carbon atoms and more preferred about 2 carbon atoms;
M represents H or a cation; and
m represents the number equal to a valence number of M;
a source of alkalinity;
water; and wherein the weight-% ratio a) of the total amount of amine oxides to b) the total amount of anion tenside are in the range of about 1:4 to about 1 to 0.2.

According to another aspect an aqueous foaming cleaning composition is provided, wherein the weight-% ratio a) of the total amount of amine oxides to b) the total amount of anion tenside are in the range of about 1:3 to about 1 to 0.3, further more preferred about 1:0.8 to about 1 to 0.4, whereby the weight-% is based on the total weight of the composition.

According to another aspect an aqueous foaming cleaning composition is provided, wherein the aqueous foaming cleaning composition may comprise:

a linear and/or branched $C_{12}$-alkyl dimethylamine oxide,
a linear and/or branched $C_{14}$-alkyl dimethylamine oxide;
at least one anion tenside of:
a dodecyl (oxyethylen)$_w$ sulfat, wherein w represents an average addition mole number ranging from about 1 to about 10, preferably about 2 to about 8 and more preferred about 3 to about 5, and/or
of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to about 18 carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

a source of alkalinity;

water; and wherein the weight-% ratio of the $C_{12}$-alkyl dimethylamine oxide to the $C_{14}$-alkyl dimethylamine oxide is about 5:1 to about 1:5; and wherein the weight-% ratio a) of the total amount of amine oxides to b) the total amount of anion tenside are in the range of about 1:4 to about 1 to 0.2.

According to another aspect an aqueous foaming cleaning composition is provided, wherein the weight-% ratio of the $C_{12}$-alkyl dimethylamine oxide to the $C_{14}$-alkyl dimethylamine oxide is preferably about 5:1 to about 1:5, further preferred about 4:1 to about 1:4 and in addition preferred about 3:1 to about 1:3; and the weight-% ratio a) of the total amount of amine oxides to b) the total amount of anion tenside are in the range of about 1:3 to about 1 to 0.3, further more preferred about 1:0.8 to about 1 to 0.4;

whereby the weight-% is based on the total weight of the composition.

It has been surprisingly found that the aqueous foaming cleaning composition can be used for removal of soil at reduced temperatures, while still providing excellent soil removal properties. Thus, the compositions of the present invention provide for reduced energy consumption, since it is active at lower cleaning temperatures.

The composition of the invention can be applied to the surface to be cleaned in form of a foam. The foam has compared to a liquid composition an increased dwell time and the foam treated areas can be easily tracked that avoids multiple treatment of the same area.

Furthermore, the aqueous foaming cleaning composition is active at a low components concentration thus provides a reduced chemical consumption.

According to another aspect an aqueous foaming cleaning composition is provided, wherein the composition may comprise:

a linear and/or branched $C_{12}$-alkyl dimethylamine oxide, a linear and/or branched $C_{14}$-alkyl dimethylamine oxide;

at least one anion tenside of:

a dodecyl (oxyethylen)$_w$ sulfat, wherein w represents an average addition mole number ranging from about 2 to about 8 and more preferred about 3 to about 5, and/or of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to 18 about carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

source of alkalinity;

hydrotrope;

polycarboxylate; and water.

According to another aspect an aqueous foaming cleaning composition is provided, wherein the composition may comprise:

a linear and/or branched $C_{12}$-alkyl dimethylamine oxide, a linear and/or branched $C_{14}$-alkyl dimethylamine oxide;

at least one anion tenside of:

a dodecyl (oxyethylen)$_w$ sulfat, wherein w represents an average addition mole number ranging from about 2 to about 8 and more preferred about 3 to about 5, and/or of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to 18 about carbon atoms, preferably about 10 to about 16 carbon atoms and more preferred about 12 to about 14 carbon atoms;

AO represents an alkylene oxy group having about 2 to about 4 carbon atoms, preferably about 2 to about 3 carbon atoms and more preferred about 2 carbon atoms;

n represents an average addition mole number ranging from about 1 to about 20, preferably about 2 to about 10 and more preferred about 3 to about 5;

A' represents an alkylene group having about 1 to about 3 carbon atoms, preferably about 2 to about 3 carbon atoms and more preferred about 2 carbon atoms;

M represents H or a cation; and m represents the number equal to a valence number of M;

sodium hydroxide;

cumene sulfonate;

polyacrylate; and water.

The aqueous foaming cleaning composition can be present in form of a concentrated solution. The concentrated solution has advantages in transporting and storing. The concentrated solution can be diluted, for example prior use, by admixing a solvent, preferably water.

It should be understood that the aqueous foaming cleaning composition can be free of at least one additive selected from the group of dye, color transfer inhibitor, anti-redeposition agents, optical brighteners, builder, oil and water repellant agents, color fastness agents, starch/sizing agents, fabric softening agents, anti-microbials, fungicides, UV absorbers, fragrances and/or mixtures thereof.

DETAILED DESCRIPTION

In some aspects, the present invention relates to aqueous foaming compositions and methods for removing soils from surfaces to be cleaned. Surfaces to be cleaned are hard and/or soft surfaces. In some embodiments, the composition of the invention is applied in a clean in place process (CIP) and/or in a clean out of place process (COP). According to the present invention it is preferred that the clean in place process (CIP) is a fully automated cleaning process that requires no reconstruction of the production plant before execution of the cleaning.

In other embodiments, the compositions of the invention may be manually applied to the surface to be cleaned. In particular the compositions of the invention can be used in the food processing industry, such as meat processing industry, for cleaning purposes.

The aqueous foaming cleaning composition can be a two component composition that can be mixed in situ.

The aqueous foaming cleaning composition can be applied to the surfaces to be cleaned in form of foam. Applying foam to an upright surface to be cleaned provides a long lasting contact time and the treated areas can be easily traced.

The aqueous foaming cleaning composition allows for the use of reduced levels of chemistry, e.g., an alkaline source and/or an active oxygen source, during cleaning, because the cleaning composition of the invention has a remarkable increased cleaning efficiency that allows the use of a lower concentrated cleaning composition. Thus, the methods of the present invention provide for reduced energy consumption, e.g., lower cleaning temperatures, and reduced chemical consumption.

So that the invention maybe more readily understood, certain terms are defined.

As used herein, "by weight" refers to the total weight of the composition. For example, if a composition has a total weight of 100 grams and comprises 40% (by weight) of an alcohol, the composition may comprise 40 grams of alcohol.

It is understood that the total weight percent amount of all components, substances or agents of a composition are selected such that it does not exceed 100 wt.-%.

It is understood that, as used here, "percent", "%", and the like are intended to be synonymous with "weight percent", "wt-%", etc.

As used herein, the term "surface" refers to a surface of a medical instrument, a healthcare setting, a tool, a machine, equipment, a structure, a building, or the like that is employed as part of a food processing, preparation, or storage activity. Examples of healthcare settings include hospitals, doctor's offices and long term care facilities. Examples of food processing surfaces include surfaces of food processing or preparation equipment, e.g., slicing, canning, or transport equipment, including flumes, of food processing wares, e.g., utensils, dishware, wash ware, and bar glasses), and of floors, walls, or fixtures of structures in which food processing occurs. Food processing surfaces are found and employed in milking machines, food anti-spoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, auto dish sanitizers, sanitizing gels, cooling towers, food processing antimicrobial garment sprays, and non-to-low-aqueous food preparation lubricants, oils, and rinse additives.

As used herein, the term "ware" refers to items such as eating and cooking utensils, dishes, and other hard surfaces such as showers, sinks, toilets, bathtubs, countertops, windows, mirrors, transportation vehicles, and floors.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

If not other where stated the temperatures is about 23° C.

If not other where stated the humidity is about 40%±5% at about 23° C.

It should be noted that, as used in this specification and the appended claims, the singular forms "a", "an", and "the" include plural referents unless the content clearly dictates otherwise. Thus, for example, reference to a composition containing "a compound" includes a composition having two or more compounds.

It should also be noted that the term "or" is generally employed in its sense including "and/or" unless the content clearly dictates otherwise.

It is specifically understood that any numerical value recited herein (e.g., ranges) includes all values from the lower value to the upper value, i.e., all possible combinations of numerical values between the lowest value and the highest value enumerated are to be considered to be expressly stated in this application. For example, if a concentration range is stated as 1% to 50%, it is intended that values such as 2% to 40%, 10% to 30%, or 1% to 3%, etc., are expressly enumerated in this specification. These are only examples of what is specifically intended.

In some embodiments, the compositions of the invention including the foam can have an alkaline pH, for example a pH of about 7.0 to about 14.

According to one aspect the aqueous foaming cleaning composition as well as the foam has a pH in the range of about 7.0 to about 14.0, preferably a pH in the range of about 9.5 to about 13.0 and more preferred a pH in the range of about 11.0 to about 12.5.

The methods, and compositions of the present invention can include, or consist essentially of, or consist, of the steps, and ingredients of the present invention as well as other ingredients described herein. As used herein, "consisting essentially of" means that the methods, and compositions may include additional steps, or ingredients, but only if the additional steps, or ingredients do not materially alter the basic and novel characteristics of the claimed methods, and compositions.

In some aspects, the methods and compositions of the present invention may be applied to equipment generally cleaned using clean in place cleaning procedures. Examples of such equipment include evaporators, heat exchangers, including tube-in-tube exchangers, direct steam injection, and plate-in-frame exchangers, heating coils, including steam, flame or heat transfer fluid heated, re-crystallizers, pan crystallizers, spray dryers, drum dryers, and tanks.

The methods and compositions of the present invention may be used in any application where thermally degraded soils, i.e., caked on soils or burned on soils, such as proteins or carbohydrates, need to be removed. As used herein, the term "thermally degraded soil" refers to a soil or soils that have been exposed to heat and as a result have become baked on to the surface to be cleaned. Exemplary thermally degraded soils include food soils that have been heated during processing, e.g., dairy products heated on pasteurizers, fructose, or corn syrup.

The methods and compositions of the present invention may also be used to remove other non-thermally degraded soils that are not easily removed using conventional cleaning techniques. Soil types suited to cleaning with the methods of the present invention include, but are not limited to, starch, cellulosic fiber, protein, simple carbohydrates and combinations of any of these soil types with mineral complexes. Examples of specific food soils that are effectively removed using the methods of the present invention include, but are not limited to, meat residues, blood residues, protein residues, vegetable and fruit juices, brewing and fermentation residues, soils generated in sugar beet and cane processing, and soils generated in condiment and sauce manufacture, e.g., ketchup, tomato sauce, barbeque sauce. These soils can develop on heat exchange equipment surfaces and on other surfaces during the manufacturing and packaging process.

Exemplary industries in which the methods and compositions of the present invention can be used include, but are not limited to: the food and beverage industry, e.g., the meat processing industry; dairy, cheese, sugar, and brewery industries; oil processing industry; industrial agriculture and ethanol processing; and the pharmaceutical manufacturing industry.

Conventional CIP as well as COP processing is generally well-known. The process includes applying a foam composition of the invention onto the surface to be cleaned. The foam adheres on the surface for slowly removing the soil.

The process to remove a soil according to the invention can includes an alkaline foam wash. According to one embodiment of the invention a process to remove a soil can include a fresh water rinse and an alkaline foam wash or a fresh water rinse, an alkaline foam wash and a fresh water rinse. Another embodiment of a process of the invention to remove soil can comprise at least three steps: an alkaline foam wash, an acid solution wash, and then a fresh water rinse. The alkaline foam softens the soils and removes the organic alkaline soluble soils. The subsequent acid solution removes mineral soils left behind by the alkaline cleaning step. The strength of the alkaline and acid solutions and the duration of the cleaning steps are typically dependent on the durability of the soil. The water rinse removes any residual solution and soils, and cleans the surface prior to the equipment being returned on-line.

The methods and compositions of the present invention provide for enhanced soil removal at reduced temperatures, e.g., about ≥1° C. to ≤60° C., preferably at about 25° C. to about 50° C. or at about 30° C. to about 40° C. The present invention also provides for a reduction in the amount of chemistry and water consumed during the cleaning process. Thus, the present invention provides both energy and water savings, while achieving effective soil removal.

The composition of the invention can be applied by spray as foam to the surface to be cleaned. By "spray" the present invention means a spray of discrete droplets or a jet of foam.

According to one embodiment, the foam composition of the invention has a foam stability, wherein the reduction of foam volume after 1 minute is about 10 vol.-% to 20 vol.-%, after 2 minute is about 15 vol.-% to 25 vol.-%, after 5 minute is about 15 vol.-% to 25 vol.-% and after 10 minute is about 20 vol.-% to 30 vol.-%, based on the initial foam volume.

The foam stability allows an improved cleaning effect, because the foam as such can be considered as a carrier for the aqueous foaming composition. It ensures that the foam of the aqueous foaming cleaning composition can also adhere to vertical surface and ceilings. As a result, long lasting contact time is achieved between the foam of the aqueous foaming cleaning composition and the surface to be cleaned. The foam layer of the aqueous foaming cleaning composition has a repository effect, i.e. through destruction of further foam bubbles new cleaning agent solution is constantly transported to the surface.

According to one preferred embodiment, the foam composition of the invention having a mean foam pore diameter size $D_{50}$ in the range of ≥10 μm to about ≤2000 μm, preferably ≥80 μm to about ≤1000 μm, and more preferred ≥100 μm to about ≤300 μm.

The increased foam stability and foam pore size of the foamed composition according to the present invention provides beside the improved cleaning activity of the selected components an additional increase of the cleaning effect.

Surfactants

A surfactant or mixture of surfactants may be used in the methods of the present invention. The surfactant chosen may be compatible with the surface to be cleaned. According to one aspect the surfactant can be preferably selected from the group comprising anionic surfactant and/or non-ionic surfactant. It can be preferred that the surfactant is selected from the group comprising of linear alkyl benzene sulfonates, alcohol sulfonates, amine oxides, alcohol ethoxylates, alkyl phenol ethoxylates, polyethylene glycol esters, EO/PO block copolymers, and mixtures thereof.

In addition, the level and degree of foaming under the conditions of use and in subsequent recovery of the composition may be a factor for selecting particular surfactants and mixtures of surfactants. In particular, the nonionics and anionics may be used in combination.

The examples mentioned in the specification are merely specific illustrations of the numerous surfactants which may find application within the scope of this invention. It should be understood that the selection of particular surfactants or combinations of surfactants may be based on a number of factors including compatibility with the surface to be cleaned at the intended use concentration and the intended environmental conditions including temperature and pH.

In some embodiments, the amount of total surfactant in a concentrated compositions can be about ≥0.2 wt.-% to about ≤20 wt.-%. Acceptable levels of surfactants include about ≥0.5 wt.-% to about ≤10 wt.-%, about ≥0.6 wt.-% to about ≤5 wt.-%, about ≥0.7 wt.-% to about ≤3 wt.-%, or about ≥1 wt.-% to about ≤2.5 wt.-%.

In some embodiments, the amount of total surfactant of dodecyl $(oxyethylen)_w$ sulfat, wherein w represents an average addition mole number ranging from about 1 to about 10, in a concentrated compositions can be about ≥0.2 wt.-% to about ≤20 wt.-%. Acceptable levels of surfactants include about ≥0.5 wt.-% to about ≤10 wt.-%, about ≥0.6 wt.-% to about ≤5 wt.-%, about ≥0.7 wt.-% to about ≤3 wt.-%, or about ≥1 wt.-% to about ≤2.5 wt.-%.

In some embodiments, the amount of total surfactant of lauryl ether carboxylic acid and/or myristil ether carboxylic acid represented by formula (I), in a concentrated compositions can be about ≥0.5 wt.-% to about ≤20 wt.-%. Acceptable levels of surfactants include about ≥1 wt.-% to about ≤10 wt.-%, about ≥3 wt.-% to about ≤6 wt.-%, or about ≥4 wt.-% to about ≤5 wt.-%.

Nonionic Surfactants

Nonionic surfactants suitable for use in the composition of the present invention include, but are not limited to, at least a $C_{12}$-alkyl dimethylamine oxide and at least a $C_{14}$-alkyl dimethylamine oxide.

However, additional nonionic alkyl dimethylamine oxide surfactants selected from the group of $C_{10}$ to $C_{18}$-alkyl dimethyl amine oxides may be used. Examples of the linear and/or branched alkyl group include various decyl, undecyl, dodecyl, tridecyl, tetradecyl, pentadecyl, hexadecyl, heptadecyl and octadecyl groups. Examples of the linear and/or branched alkenyl group as R include various decenyl, undecenyl, dodecenyl, tridecenyl, tetradecenyl, pentadecenyl, hexadecenyl, heptadecenyl and octadecenyl groups. Examples of an aliphatic linear and/or branched alkyl group having a cyclic structure include groups of cyclodecyl, cyclododecyl, cyclooctenyl, cyclodecenyl, cyclododecenyl, 2-(cyclohexyl)ethyl, 3-(cyclohexyl)propyl, 2-(cyclohexenyl) ethyl, and 3-(cyclohexenyl)propyl groups.

In some embodiments, the total amount of the mixture of a linear and/or branched $C_{12}$-alkyl dimethylamine oxide and of a linear and/or branched $C_{14}$-alkyl dimethylamine oxide in the aqueous foaming composition, preferably in the concentrated aqueous foaming composition, can be about ≥0.1 wt.-% to about ≤10 wt.-%, preferably about ≥0.2 wt.-% to about ≤5 wt.-%, and further preferred about ≥0.5 wt.-% to about ≤1 wt.-%.

In some embodiments, the total amount of the mixture of a linear $C_{12}$-alkyl dimethylamine oxide and of a linear $C_{14}$-alkyl dimethylamine oxide in the aqueous foaming composition, preferably in the concentrated aqueous foaming composition, can be about ≥0.1 wt.-% to about ≤10 wt.-%, preferably about ≥0.2 wt.-% to about ≤5 wt.-%, and further preferred about ≥0.5 wt.-% to about ≤1 wt.-%.

In some embodiments, the total amount of the mixture of a linear $C_{12}$-alkyl dimethylamine oxide and of a linear $C_{14}$-alkyl dimethylamine oxide in the aqueous foaming composition, preferably in the concentrated aqueous foaming composition, can be about ≥0.5 wt.-% to about ≤1 wt.-%.

In some embodiments, the total amount of the mixture of a linear and/or branched $C_{12}$-alkyl dimethylamine oxide and of a linear and/or branched $C_{14}$-alkyl dimethylamine oxide in the aqueous foaming composition, preferably in the diluted aqueous foaming composition, can be about ≥0.002 wt.-% to about ≤0.2 wt.-%, preferably about ≥0.004 wt.-% to about ≤0.1 wt.-%, and further preferred about ≥0.01 wt.-% to about ≤0.02 wt.-%.

In some embodiments, the total amount of the mixture of a linear $C_{12}$-alkyl dimethylamine oxide and of a linear $C_{14}$-alkyl dimethylamine oxide in the aqueous foaming composition, preferably in the diluted aqueous foaming composition, can be about ≥0.002 wt.-% to about ≤0.2 wt.-%, preferably about ≥0.004 wt.-% to about ≤0.1 wt.-%, and further preferred about ≥0.01 wt.-% to about ≤0.02 wt.-%.

In some embodiments, the total amount of the mixture of a linear $C_{12}$-alkyl dimethylamine oxide and of a linear $C_{14}$-alkyl dimethylamine oxide in the aqueous foaming composition, preferably in the diluted aqueous foaming composition, can be about ≥0.01 wt.-% to about ≤0.02 wt.-%.

Acceptable levels of $C_{10}$ to $C_{18}$-alkyl dimethylamine oxide include about ≥0.4 wt.-% to about ≤1 wt.-%, preferably about ≥0.5 wt.-% to about ≤0.9 wt.-% and more preferred about ≥0.6 wt.-% to about ≤0.8 wt.-%.

According to one aspect the aqueous foaming cleaning composition may contains two alkyl dialkylamines oxides only, namely lauramine oxide and tetradecyl dimethylamine oxide.

According to one aspect the aqueous foaming cleaning composition can be free of nonionic surfactants except alkyl dialkylamines oxides.

According to one aspect the aqueous foaming cleaning composition can be free of nonionic surfactants except lauramine oxide and tetradecyl dimethylamine oxide.

Aniontenside

Anionic surfactants suitable for use in the composition of the present invention include:

at least one dodecyl $(oxyethylen)_w$ sulfat, wherein w represents an average addition mole number ranging from about 1 to about 10; and/or at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to about 18 carbon atoms;

AO represents an alkylene oxy group having about 2 to about 4 carbon atoms; n represents an average addition mole number ranging from about 1 to about 20;

A' represents an alkylene group having about 1 to about 3 carbon atoms;

M represents H or a cation; and m represents the number equal to a valence number of M.

According to one aspect the aqueous foaming cleaning composition may contain one anionic surfactant only, preferably a dodecyl $(oxyethylen)_w$ sulfat, wherein w represents an average addition mole number ranging from about 1 to about 10; or of at least one polyoxyalkylene alkyl ether carboxylic acid or salt thereof represented by formula (I).

According to one aspect the aqueous foaming cleaning composition may contain a mixture of two anionic surfactants, namely a dodecyl $(oxyethylen)_w$ sulfat, wherein w represents an average addition mole number ranging from about 1 to about 10; and of at least one polyoxyalkylene alkyl ether carboxylic acid or salt thereof represented by formula (I).

According to one aspect, wherein w of the dodecyl $(oxyethylen)_w$ sulfat may represents an average addition mole number ranging from about 1 to about 10, preferably about 2 to about 8 and more preferred about 3 to about 5.

The polyoxyalkylene alkyl ether carboxylic acid of formula (I) can have any appropriate structure determined according to desired properties and intended use thereof. From the viewpoint of properties as detergent base, R may have about 8 to about 18 carbon atoms, and preferably about 10 to about 14 carbon atoms. Examples of the linear and/or branched alkyl group as R may include an alkyl group and/or an alkenyl group. R may be a linear and/or branched, primary or secondary group.

Examples of the linear and/or branched alkyl group as R include various octyl, nonyl, decyl, undecyl, dodecyl, tridecyl, tetradecyl, pentadecyl, hexadecyl, heptadecyl and octadecyl groups.

Examples of the linear and/or branched alkenyl group as R include various octenyl, nonenyl, decenyl, undecenyl, dodecenyl, tridecenyl, tetradecenyl, pentadecenyl, hexadecenyl, heptadecenyl and octadecenyl groups.

Examples of an aliphatic linear and/or branched alkyl group having a cyclic structure include groups of cyclooctyl, cyclodecyl, cyclododecyl, cyclooctenyl, cyclodecenyl, cyclododecenyl, 2-(cyclohexyl)ethyl, 3-(cyclohexyl)propyl, 2-(cyclohexenyl)ethyl, and 3-(cyclohexenyl)propyl groups.

From the viewpoints of versatility as a raw material and economic efficiency, AO may represents an ethyleneoxy group having 2 carbon atoms, and preferably not less than 80% by mole of the total of AOs are ethyleneoxy groups. From the viewpoint of fluidity in a reaction mixture, n is preferably a number of about 1 to about 10. Of course, a mixture of compounds having different structures, collectively represented by formula (I), can be used.

In formula (I), the alkyleneoxy group having about 2 to about 4 carbon atoms represented by AO is an ethyleneoxy, propyleneoxy, or butyleneoxy group. AO is preferably an alkyleneoxy group having 2 to about 3 carbon atoms, and more preferably an ethyleneoxy group or a mixture of an ethyleneoxy and a propyleneoxy (propane-1,2-diyloxy) groups.

From the viewpoints of foaming properties and feeling in use, an average addition mole number of alkyleneoxy groups is for n preferably about 2 to about 10 and more preferably 3 to about 5, and even more preferably n is about 1 or 2.

M preferably represents a hydrogen ion or an alkali metal ion.

According to a preferred aspect a concentrated aqueous foaming cleaning composition may contains about ≥0.1 wt.-% to about ≤10 wt.-%, preferably about ≥0.2 wt.-% to about ≤5 wt.-%, and further preferred about ≥0.5 wt.-% to about ≤2 wt.-% of at least one or a mixture of polyoxyalkylene alkyl ether carboxylic acid or salt thereof represented by formula (I).

According to a preferred aspect a concentrated aqueous foaming cleaning composition may contains about ≥0.1 wt.-% to about ≤10 wt.-%, preferably about ≥0.2 wt.-% to about ≤5 wt.-%, and further preferred about ≥0.5 wt.-% to about ≤2 wt.-% of at least one or a mixture of polyoxyalkylene alkyl ether carboxylic acid or salt thereof, represented by formula (I), wherein represents a linear and/or branched alkyl group having about 10 to about 16 carbon atoms, preferably about 12 to about 14 carbon atoms.

According to a preferred aspect a concentrated aqueous foaming cleaning composition may contains about ≥0.1 wt.-% to about <2.5 wt.-%, preferably about ≥0.2 wt.-% to about ≤2 wt.-% and more preferred about ≥0.3 wt.-% to about ≤1 wt.-% of lauryl ether carboxylic acid or myristyl ether carboxylic acid or salt thereof, represented by formula (I), or preferably a mixture of a lauryl ether carboxylic acid and myristyl ether carboxylic acid or salts thereof, represented by formula (I).

According to a preferred aspect a diluted aqueous foaming cleaning composition may contains about ≥0.002 wt.-% to about ≤0.2 wt.-%, preferably about ≥0.004 wt.-% to about ≤0.1 wt.-%, and further preferred about ≥0.01 wt.-% to about ≤0.04 wt.-%, of at least one or a mixture of polyoxyalkylene alkyl ether carboxylic acid or salt thereof represented by formula (I).

According to a preferred aspect a diluted aqueous foaming cleaning composition may contains about ≥0.002 wt.-% to about ≤0.2 wt.-%, preferably about ≥0.004 wt.-% to about ≤0.1 wt.-%, and further preferred about ≥0.01 wt.-% to about ≤0.04 wt.-%, of at least one or a mixture of polyoxyalkylene alkyl ether carboxylic acid or salt thereof represented by formula (I), wherein represents a linear and/or branched alkyl group having about 10 to about 16 carbon atoms, preferably about 12 to about 14 carbon atoms.

According to a preferred aspect a diluted aqueous foaming cleaning composition may contains about ≥0.002 wt.-% to about ≤0.2 wt.-%, preferably about ≥0.004 wt.-% to about ≤0.1 wt.-%, and further preferred about ≥0.01 wt.-% to about ≤0.04 wt.-%, of lauryl ether carboxylic acid or myristyl ether carboxylic acid or salt thereof, represented by formula (I), or preferably a mixture of a lauryl ether carboxylic acid and myristyl ether carboxylic acid or salts thereof, represented by formula (I).

According to one aspect the aqueous foaming cleaning composition may contains two anionic surfactants of polyoxyalkylene alkyl ether carboxylic acids or salt thereof represented by formula (I) only, namely a mixture of a lauryl ether carboxylic acid and a myristyl ether carboxylic acid or salts thereof, represented by formula (I).

According to one aspect the aqueous foaming cleaning composition can be free of anionic surfactants except polyoxyalkylene alkyl ether carboxylic acids or salt thereof represented by formula (I).

According to one aspect the aqueous foaming cleaning composition can be free of anionic surfactants except lauryl ether carboxylic acid and a myristyl ether carboxylic acid or salts thereof, represented by formula (I).

Alkalinity Source

In some aspects, the compositions of the present invention include a source of alkalinity. Exemplary alkaline sources suitable for use with the present invention include, but are not limited to are, basic salts, amines, carbonates and silicates, and mixtures thereof. Other exemplary alkaline sources for use with the methods of the present invention include NaOH (sodium hydroxide), KOH (potassium hydroxide), TEA (triethanol amine), DEA (diethanol amine), MEA (monoethanolamine), sodium carbonate, and morpholine, sodium metasilicate and potassium silicate. The alkaline source selected may be compatible with the surface to be cleaned. Preferably, the source of alkalinity is selected from the group comprising sodium hydroxide, potassium hydroxide or a mixture thereof, most preferred is sodium hydroxide.

According to a more preferred aspect the aqueous foaming cleaning composition may comprise a sources of alkalinity wherein the sources of alkalinity include alkali metal hydroxides, alkali metal salts, phosphates, amines, and mixtures thereof, preferably alkali metal hydroxides including sodium hydroxide, potassium hydroxide, and lithium hydroxide, or is a mixture, and most preferred the sources of alkalinity is sodium hydroxide.

The amount of alkaline source present is dependent on a variety of factors including, for example, the type of surface to be cleaned, and the amount and type of soil present on the surface.

In some embodiments of the aqueous foaming composition, the amount of alkaline source present in a concentrated aqueous foaming cleaning composition can be about ≥0.5 wt.-% to about ≤10 wt.-%, preferably about ≥1 wt.-% to about ≤8 wt.-%, and further preferred about ≥2 wt.-% to about ≤5 wt.-%; wherein the source of alkalinity is preferably sodium hydroxide.

In some embodiments of the aqueous foaming composition, the amount of alkaline source present in a diluted aqueous foaming cleaning composition can be about ≥0.01 wt.-% to about ≤0.2 wt.-%, preferably about ≥0.02 wt.-% to about ≤0.16 wt.-%, and further preferred about ≥0.04 wt.-% to about ≤0.1 wt.-%; wherein the source of alkalinity is preferably sodium hydroxide.

It is understood that the "nonionic surfactants of linear and/or branched $C_{12}$-alkyl dimethylamine oxide and linear and/or branched $C_{14}$-alkyl dimethylamine oxide" are not regarded as an alkaline source.

According to one aspect the aqueous foaming cleaning composition can be free of an alkaline source except sodium hydroxide.

Hydrotropes

Solubilizing intermediaries called hydrotropes. A hydrotrope is a compound that solubilizes hydrophobic compounds in aqueous solutions. Typically, hydrotropes consist of a hydrophilic part and a hydrophobic part (like surfactants) but the hydrophobic part is generally too small to cause spontaneous self-aggregation. Hydrotropes may be present in the aqueous foaming composition.

Hydrotropes that can be suitable used are selected from the group comprising aromatic hydrocarbon sulfonate, preferably xylene sulfonate, toluene sulfonate, or cumene sulfonate; or n-octane sulfonate; or their sodium-, potassium- or ammonium salts or as salts of organic ammonium bases.

Also commonly used are polyols containing only carbon, hydrogen and oxygen atoms. They preferably contain from about 2 to about 6 carbon atoms and from about 2 to about 6 hydroxy groups. Examples include 1,2-propanediol, 1,2-butanediol, hexylene glycol, glycerol, sorbitol, mannitol, and glucose.

In some preferred embodiments the hydrotrope may be selected from the group comprising of a xylene sulfonate, toluene sulfonate, or cumene sulfonate, n-octane sulfonate, and/or acids thereof and also more preferred cumene sulfonate.

In some embodiments, Na-cumolsulfonate, linear alkylbenzene sulfonates (LAS) and/or xylene sulfonate, cumolsulfonate may be suitable to use as hydrotrope and having an improved wetting effect.

According to a more preferred aspect the aqueous foaming cleaning composition may comprise at least one hydrotrope that is a cumene sulfonate.

In some embodiments, the concentrated aqueous foaming cleaning composition may comprise a hydrotrope, preferably cumolsulfonate or the acid thereof, in the range of about ≥0 wt.-% to about ≤10 wt.-%, preferably about ≥1 wt.-% to about ≤5 wt.-% and more preferred about ≥2 wt.-% to about ≤4 wt.-%, by weight of the total aqueous foaming composition.

In some embodiments, the diluted aqueous foaming cleaning composition may comprise a hydrotrope, preferably cumolsulfonate or the acid thereof, in the range of about ≥0 wt.-% to about ≤0.2 wt.-%, preferably about ≥0.02 wt.-% to about ≤0.1 wt.-% and more preferred about ≥0.04 wt.-% to about ≤0.08 wt.-%, by weight of the total aqueous foaming composition.

It should be understood that the hydrotrope can present in the form of an acid or salt thereof, depending on the pH of the aqueous foaming composition.

It should be understood that the aqueous foaming cleaning composition can be free of a hydrotrope.

According to one aspect the aqueous foaming cleaning composition can be free of a hydrotrope, except cumolsulfonate or the corresponding acid thereof.

Polymeric Polycarboxylate

The aqueous foaming cleaning composition may include at least one polymeric polycarboxylate. The polymeric polycarboxylates suitable for use include those having a pendant carboxylate (—$CO_2$) groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

Further suitable copolymeric polycarboxylates are particularly those of acrylic acid with methacrylic acid and of acrylic acid or methacrylic acid with maleic acid.

Copolymers of acrylic acid with maleic acid, which comprise about 50 wt.-% to about 90 wt.-% acrylic acid and about 50 wt.-% to about 10 wt.-% maleic acid, have proven to be particularly suitable.

More preferred suitable polycarboxylates are the polyacrylates, which preferably have a molecular weight of 1,000 to 50,000 g/mol and preferably about 2,000 to 10,000 g/mol.

In some embodiments the aqueous foaming cleaning composition may comprise a polymeric polycarboxylate, preferably a polyacrylate having a molecular weight of about 500 Mw to about 50000 Mw, preferably about 1000 Mw to about 20000 Mw, in addition preferred about 3000 Mw to about 10000 Mw and more preferred about 4000 Mw to about 6000 Mw, wherein the molecular weight of the polymeric polycarboxylate is based on a totally neutralized sodium polymeric polycarboxylate.

More preferred is a polymeric polycarboxylate that is a polyacrylate.

In some embodiments, a concentrated aqueous foaming cleaning composition may comprise the polymeric polycarboxylate, preferably polyacrylate, in an amount of about ≥0 wt.-% to about ≤5 wt.-%, preferably about ≥0.5 wt.-% to about ≤2 wt.-% and more preferred about ≥0.7 wt.-% to about ≤1 wt.-% of a polycarboxylate, preferably polyacrylate of a polymeric polycarboxylate, based on the total weight amount of the aqueous foaming composition.

In some embodiments, a concentrated aqueous foaming cleaning composition may comprise the polymeric polycarboxylate, preferably polyacrylate, in an amount of about ≥0 wt.-% to about ≤5 wt.-%, preferably about ≥0.5 wt.-% to about ≤2 wt.-% and more preferred about ≥0.7 wt.-% to about ≤1 wt.-% of a polycarboxylate, preferably polyacrylate having about 4000 Mw to about 6000 Mw, based on the total weight amount of the aqueous foaming composition.

In some embodiments, a diluted aqueous foaming cleaning composition may comprise the polymeric polycarboxylate, preferably polyacrylate, in an amount of about ≥0 wt.-% to about ≤0.1 wt.-%, preferably about ≥0.01 wt.-% to about ≤0.04 wt.-% and more preferred about ≥0.014 wt.-% to about ≤0.02 wt.-% of a polycarboxylate, preferably polyacrylate of a polymeric polycarboxylate, based on the total weight amount of the aqueous foaming composition.

In some embodiments, a diluted aqueous foaming cleaning composition may comprise the polymeric polycarboxylate, preferably polyacrylate, in an amount of about ≥0 wt.-% to about ≤0.1 wt.-%, preferably about ≥0.01 wt.-% to about ≤0.04 wt.-% and more preferred about ≥0.014 wt.-% to about ≤0.02 wt.-% of a polycarboxylate, preferably polyacrylate having about 4000 Mw to about 6000 Mw, based on the total weight amount of the aqueous foaming composition.

By virtue of their superior solubility, preferred representatives of this group of polymeric polycarboxylate are the short-chain polyacrylates, which have molecular weights, based on free acids, of 2,000 g/mol to 10,000 g/mol and, more particularly, 4,000 g/mol to 6,000 g/mol.

It should be understood that the aqueous foaming cleaning composition can be free of a polymeric polycarboxylate.

According to one aspect the aqueous foaming cleaning composition can be free of a polymeric polycarboxylate, except a polyacrylate.

Solvent

A solvent, preferably water, can be added add. 100 wt.-% to the aqueous foaming composition. The solvent content, such as the water content, of the aqueous foaming cleaning composition is simply determined by subtracting the weight-% amounts of all the other components, based on the total weight of the aqueous foaming composition, except the solvent, from 100 wt. %.

Suitable solvents include, but are not limited to, water, alcohols, glycols, glycol ethers, esters, and the like, or combinations thereof. Suitable alcohols include, but are not limited to, ethanol, isopropanol (propan-2-ol), 2-butoxy ethanol (butyl glycol), 1-decanol, benzyl alcohol, glycerin, monoethanolamine (MEA), and the like, or combinations thereof.

Suitable glycols include, but are not limited to, ethylene glycol (monoethylene glycol or MEG), diethylene glycol (propylene glycol or butoxy diglycol or DEG), triethylene glycol (TEG), tetraethylene glycol (TETRA EG), glycerin, propylene glycol, dipropylene glycol, hexylene glycol, and the like, or combinations thereof. Preferably the composition may comprise at least two solvents and more preferred the composition may comprise water and hexylene glycol.

In some embodiments, a concentrated aqueous foaming cleaning composition may comprise the solvent, preferably water, in an amount of about ≥45 wt.-%, preferably about ≥70 wt.-% and further preferred about ≥85 wt.-% to about ≤92 wt.-%, based on the total weight amount of the aqueous foaming composition.

In some embodiments, a diluted aqueous foaming cleaning composition may comprise the solvent, preferably water, in an amount of about ≥98 wt.-%, preferably about ≥99 wt.-% and further preferred about ≥99.9 wt.-%, based on the total weight amount of the aqueous foaming composition.

A diluted aqueous foaming cleaning composition is obtainable by diluting a concentrated liquid composition with a solvent, preferably water, in a ratio of concentrated liquid composition to solvent, preferably water, of about 1:5000 to 1:5, preferably of about 1:1000 to 1:10, in particular of about 1:100 to 1:20, and also preferred of about 1:50 to 1:30.

Concentrate

The liquid foaming cleaning composition can be presented in a concentrated liquid form. The concentrates include a liquid medium, preferably water, and relatively large concentrations of the active cleaning component or cleaning components. The concentrated liquid cleaning composition may have a pH in the range of about 7.0 to about 14.0, preferably a pH in the range of about 8.5 to about 13.0 and more preferred a pH in the range of about 10.0 to about 12.5 and for the diluted liquid foaming cleaning composition the pH may be adjusted to a pH of about 7.0 to pH of about 14.0, preferably to a pH of about 8.0 to pH of about 12.5 and more preferred to a pH of about 9.5 to pH of about 11.5.

As a solvent, preferably water is added to 100 wt.-% to the concentrated liquid foaming cleaning composition, wherein the weight.-% of the components are based on the total weight of the concentrated liquid foaming cleaning composition, and the weight.-% of all components of the cleaning composition are select so that it does not exceed 100 wt.-%.

According to one aspect, a concentrated aqueous foaming cleaning composition may comprise:

- about ≥0.1 wt.-% to about ≤10 wt.-%, preferably about ≥0.2 wt.-% to about ≤5 wt.-%, and further preferred about ≥0.5 wt.-% to about ≤1 wt.-%, of a mixture of a linear and/or branched $C_{12}$-alkyl dimethylamine oxide and of a linear and/or branched $C_{14}$-alkyl dimethylamine oxide;
- at least one anion tenside of:
  - about ≥0.1 wt.-% to about ≤10 wt.-%, preferably about ≥0.2 wt.-% to about ≤5 wt.-%, and further preferred about ≥0.3 wt.-% to about ≤1 wt.-%, of a dodecyl $(oxyethylen)_w$ sulfat, wherein w represents an average addition mole number ranging from about 1 to about 10, preferably about 2 to about 8 and more preferred about 3 to about 5, and/or
  - about ≥0.1 wt.-% to about ≤10 wt.-%, preferably about ≥0.2 wt.-% to about ≤5 wt.-%, and further preferred about ≥0.5 wt.-% to about ≤2 wt.-%, of at least one or a mixture of polyoxyalkylene alkyl ether carboxylic acid or salt thereof represented by formula (I);
- about ≥0.5 wt.-% to about ≤10 wt.-%, preferably about ≥1 wt.-% to about ≤8 wt.-%, and further preferred about ≥2 wt.-% to about ≤5 wt.-%, of a source of alkalinity; preferably sodium hydroxide; and
- about ≥60 wt.-%, preferably about ≥70 wt.-% and further preferred about ≥85 wt.-% to about ≤92 wt.-%, water; wherein the wt.-% of the components are based on the total weight of the composition and the components are selected such that the total weight amount of the components of the concentrated composition does not exceed 100 wt.-%.

According to one aspect, a concentrated aqueous foaming cleaning composition may comprise:

- about ≥0.1 wt.-% to about ≤10 wt.-%, preferably about ≥0.2 wt.-% to about ≤5 wt.-%, and further preferred about ≥0.5 wt.-% to about ≤1 wt.-%, of a mixture of a linear and/or branched $C_{12}$-alkyl dimethylamine oxide and of a linear and/or branched $C_{14}$-alkyl dimethylamine oxide;
- at least one anion tenside of:
  - about ≥0.1 wt.-% to about ≤10 wt.-%, preferably about ≥0.2 wt.-% to about ≤5 wt.-%, and further preferred about ≥0.3 wt.-% to about ≤1 wt.-%, of a dodecyl $(oxyethylen)_w$ sulfat, wherein w represents an average addition mole number ranging from about 1 to about 10, preferably about 2 to about 8 and more preferred about 3 to about 5, and/or
  - about ≥0.1 wt.-% to about ≤10 wt.-%, preferably about ≥0.2 wt.-% to about ≤5 wt.-%, and further preferred about ≥0.5 wt.-% to about ≤2 wt.-%, of at least one or a mixture of polyoxyalkylene alkyl ether carboxylic acid or salt thereof represented by formula (I);
- about ≥0.5 wt.-% to about ≤10 wt.-%, preferably about ≥1 wt.-% to about ≤8 wt.-%, and further preferred about ≥2 wt.-% to about ≤5 wt.-%, of a source of alkalinity; preferably sodium hydroxide; and
- about ≥60 wt.-%, preferably about ≥70 wt.-% and further preferred about ≥85 wt.-% to about ≤92 wt.-%, water; wherein the wt.-% of the components are based on the total weight of the composition and the components are selected such that the total weight amount of the components of the concentrated composition does not exceed 100 wt.-%.

According to another aspect, a concentrated aqueous foaming cleaning composition may comprise:

about ≥0.5 wt.-% to about ≤1 wt.-%, of a mixture of a linear and/or branched $C_{12}$-alkyl dimethylamine oxide and of a linear and/or branched $C_{14}$-alkyl dimethylamine oxide;

at least one anion tenside of:

about ≥0.3 wt.-% to about ≤1 wt.-%, of a dodecyl (oxyethylen)$_w$ sulfat, wherein w represents an average addition mole number ranging from 3 to about 5, and/or about ≥0.5 wt.-% to about ≤2 wt.-%, of a mixture of lauryl ether carboxylic acid and myristil ether carboxylic acid represented by formula (I);

about ≥2 wt.-% to about ≤5 wt.-%, of a source of alkalinity; preferably sodium hydroxide;

about ≥2 wt.-% to about ≤4 wt.-% of a hydrotrope, preferably cumene sulfonate;

about ≥0.7 wt.-% to about ≤1 wt.-% of a polyacrylate;

about ≥85 wt.-% to about ≤92 wt.-%, water; wherein the wt.-% of the components are based on the total weight of the composition and the components are selected such that the total weight amount of all components of the composition does not exceed 100 wt.-%.

Ready-to-use Composition

The liquid foaming cleaning composition can be present in form of a diluted or so called "ready-to-use" composition. The diluted compositions may be derived from a concentrated liquid foaming cleaning composition, for example, by combining water, for example, deionized water, city or tap water, with said concentrate. The so called ready-to-use compositions may be treated to reduce hardness.

The source of alkalinity and addition of the solvent, preferably water, are provided so that the diluted liquid foaming cleaning composition may have a pH in the range of about 8.0 pH to about 12.5 pH or about 9.0 pH to about 12.0 pH.

According to one aspect, the concentrated liquid foaming cleaning composition can be diluted with a solvent, preferably water, to an about 1.0 wt.-% to about 10 wt.-%, preferably to an about 2.0 wt.-% to 5.5 wt.-%, diluted cleaning composition, also named "ready-to-use solution".

As a solvent, preferably water is added to 100 wt.-% to the diluted liquid foaming cleaning composition, wherein the weight.-% of the components are based on the total weight of the diluted liquid foaming cleaning composition, and the weight.-% of all components of the cleaning composition are select so that it does not exceed 100 wt.-%.

According to one aspect, a diluted aqueous foaming cleaning composition may comprise:

about ≥0.002 wt.-% to about ≤0.2 wt.-%, preferably about ≥0.004 wt.-% to about ≤0.1 wt.-%, and further preferred about ≥0.01 wt.-% to about ≤0.02 wt.-%, of a mixture of a linear and/or branched $C_{12}$-alkyl dimethylamine oxide and of a linear and/or branched $C_{14}$-alkyl dimethylamine oxide;

at least one anion tenside of:

about ≥0.002 wt.-% to about ≤0.2 wt.-%, preferably about ≥0.004 wt.-% to about ≤0.1 wt.-%, and further preferred about ≥0.006 wt.-% to about ≤0.02 wt.-%, of a dodecyl (oxyethylen)$_w$ sulfat, wherein w represents an average addition mole number ranging from 1 to 10, preferably about 2 to about 8 and more preferred about 3 to about 5, and/or about ≥0.002 wt.-% to about ≤0.2 wt.-%, preferably about ≥0.004 wt.-% to about ≤0.1 wt.-%, and further preferred about ≥0.01 wt.-% to about ≤0.04 wt.-%, of at least one or a mixture of polyoxyalkylene alkyl ether carboxylic acid or salt thereof represented by formula (I);

about ≥0.01 wt.-% to about ≤0.2 wt.-%, preferably about ≥0.02 wt.-% to about ≤0.16 wt.-%, and further preferred about ≥0.04 wt.-% to about ≤0.1 wt.-%, of a source of alkalinity; preferably sodium hydroxide;

about ≥0 wt.-% to about ≤0.2 wt.-%, preferably about ≥0.02 wt.-% to about ≤0.1 wt.-% and more preferred about ≥0.04 wt.-% to about ≤0.08 wt.-% of a hydrotrope, preferably cumene sulfonate;

about ≥0 wt.-% to about ≤0.1 wt.-%, preferably about ≥0.01 wt.-% to about ≤0.04 wt.-% and more preferred about ≥0.014 wt.-% to about ≤0.02 wt.-% of a polycarboxylate, preferably polyacrylate having about 4000 Mw to about 6000 Mw;

about ≥98 wt.-%, preferably about ≥99 wt.-% and further preferred about ≥99.9 wt.-%, water; wherein the wt.-% of the components are based on the total weight of the composition and the components are selected such that the total weight amount of all components of the composition does not exceed 100 wt.-%.

According to another aspect, a diluted aqueous foaming cleaning composition may comprise:

about ≥0.002 wt.-% to about ≤0.2 wt.-% of a mixture of a linear and/or branched $C_{12}$-alkyl dimethylamine oxide and of a linear and/or branched $C_{14}$-alkyl dimethylamine oxide;

at least one anion tenside of:

about ≥0.002 wt.-% to about ≤0.2 wt.-% of a dodecyl (oxyethylen)$_w$ sulfat, wherein w represents an average addition mole number ranging from 1 to 10, and/or about ≥0.002 wt.-% to about ≤0.2 wt.-% of at least one or a mixture of polyoxyalkylene alkyl ether carboxylic acid or salt thereof, selected from the group of lauryl ether carboxylic acid and myristil ether carboxylic acid and represented by formula (I);

about ≥0.01 wt.-% to about ≤0.2 wt.-% of a source of alkalinity; preferably sodium hydroxide;

about ≥0 wt.-% to about ≤0.2 wt.-% of a hydrotrope, preferably cumene sulfonate;

about ≥0 wt.-% to about ≤0.1 wt.-% of a polycarboxylate having about 4000 Mw to about 6000 Mw;

about ≥98 wt.-%, preferably about ≥99 wt.-% water; wherein the wt.-% of the components are based on the total weight of the composition and the components are selected such that the total weight amount of all components of the composition does not exceed 100 wt.-%.

According to one aspect, a diluted aqueous foaming cleaning composition may comprise:

about ≥0.01 wt.-% to about ≤0.02 wt.-%, of a mixture of a linear and/or branched $C_{12}$-alkyl dimethylamine oxide and of a linear and/or branched $C_{14}$-alkyl dimethylamine oxide;

at least one anion tenside of:

about ≥0.006 wt.-% to about ≤0.02 wt.-%, of a dodecyl (oxyethylen)$_w$ sulfat, wherein w represents an average addition mole number ranging from about 3 to about 5, and/or about ≥0.01 wt.-% to about ≤0.04 wt.-%, of at least one or a mixture of polyoxyalkylene alkyl ether carboxylic acid or salt thereof represented by formula (I);

about ≥0.04 wt.-% to about ≤0.1 wt.-%, of a source of alkalinity; preferably sodium hydroxide;

about ≥0.04 wt.-% to about ≤0.08 wt.-% of a hydrotrope, preferably cumene sulfonate;

about ≥0.014 wt.-% to about ≤0.02 wt.-% of a polycarboxylate having about 4000 Mw to about 6000 Mw;

about ≥99.9 wt.-%, water; wherein the wt.-% of the components are based on the total weight of the composition and the components are selected such that the total weight amount of all components of the composition does not exceed 100 wt.-%.

Methods of Cleaning

In some aspects, the present invention provides methods for removing soil from a surface. In some embodiments, the methods for removing soil from a surface include using a clean out of place (COP) or clean in place (CIP) cleaning process. The methods include applying to the surface a composition of the invention, preferably in form of foam.

The method for removing soil from a surface to be cleaned may comprises applying to the surface a liquid foaming cleaning composition. According to another aspect the method for removing soil from a surface to be cleaned may comprises applying to the surface a concentrated liquid foaming cleaning composition. According to another aspect the method for removing soil from a surface to be cleaned may comprises preferably applying to the surface a diluted liquid foaming cleaning composition.

The method for removing soil from a surface to be cleaned may comprising:

a) optional applying a pre-treatment solution, preferably water, to the surface to be cleaned for an amount of time sufficient to substantially penetrate a soil on the surface to be cleaned and/or pre-clean a soil on the surface to be cleaned;

b) applying the liquid foaming cleaning composition, preferably the diluted liquid foaming cleaning composition, to the surface to be cleaned for an amount of time for cleaning the surface to be cleaned;

c) optional a rinsing step before and/or after the application (a) and/or (b).

In some embodiments, the methods and compositions of the present invention are applied to surfaces which are normally cleaned using a clean out of place or in place cleaning technique. Examples of such surfaces include hard and soft surface, for example of upper outer and/or inner outer surfaces of materials such as ceramic, metal, plastic and/or glass, surface that came into contact with beverages and/or food, beverages such alcoholic or non-alcoholic beverages such as beer or milk, food such as meat, vegetables and/or grain-products. Other surfaces that can be cleaned are instruments and apparatus, for example used in sanitary or medical services, evaporators, heat exchangers, including tube-in-tube exchangers, direct steam injection, and plate-in-frame exchangers, heating coils including steam, flame or heat transfer fluid heated re-crystallizers, pan crystallizers, spray dryers, drum dryers, and tanks.

Additional surfaces capable of being cleaned using the methods and compositions of the present invention include, but are not limited to membranes, medical devices, laundry and/or textiles, and hard surfaces, e.g., walls, floors, dishes, flatware, pots and pans, heat exchange coils, ovens, fryers, smoke houses, sewer drain lines, and vehicles. In some embodiments, the surfaces may be cleaned using a clean in place method. The methods of the present invention may also be used to remove dust from air handling equipment, for example, from air conditioners and refrigeration heat exchangers. In other embodiments, the methods of the present invention may be used for drain line microbial control, e.g., to reduce or remove biofilm formation.

Exemplary industries in which the methods and compositions of the present invention may be used include, but are not limited to: the food and beverage industry, e.g., the dairy, cheese, sugar, and brewery industries; oil processing industry; industrial agriculture and ethanol processing; and the pharmaceutical manufacturing industry.

Temperature

The methods and aqueous foaming cleaning composition for soil removal from surfaces can be applied at reduced temperatures, e.g., from about ≥15° C. to about ≤75° C., preferably at about ≥30° C. to about ≤60° C., preferably about ≥40° C. to about ≤50° C. The ability of stable foam formation and to clean at reduced temperatures, preferably at about 45° C. results in energy and cost savings compared to traditional cleaning techniques that require increased temperatures. Further, the present invention provides for effective soil removal on surfaces that cannot withstand high temperatures.

It has also been found that the methods of the present invention provide for soil removal at reduced temperatures, and using reduced amounts of chemistry, compared to conventional cleaning methods. In some embodiments, the methods of the present invention use about 25% to about 50% less chemistry, e.g., source of alkalinity, than conventional cleaning methods. Thus, the methods of the present invention may effectively remove soil at both low temperatures, and using a low concentration of chemicals, providing both an energy savings and a reduction in the amount of chemistry consumed per cleaning.

Time

In some aspects of the aqueous foaming cleaning composition for use with the methods of the present invention are applied as stable foam to the surface for a sufficient amount of time such that the composition penetrates into the soil to be removed.

In some embodiments, the composition is applied in form of a foam to the surface to be cleaned for about 1 minutes to about 60 minutes, preferably about 5 minutes to about 55 minutes, further preferred about 10 minutes to about 50 minutes.

In other embodiments, the composition is applied to the surface for about 20 to about 40 minutes. It is to be understood that all values and ranges between these values and ranges are encompassed by the methods of the present invention.

In some embodiments, the aqueous foaming cleaning composition for use with the methods of the present invention is applied as stable foam to the surface to be cleaned for about 1 to about 30 minutes. In some embodiments, the aqueous foaming cleaning composition for use with the methods of the present invention is applied as stable foam to the surface to be cleaned for about 5 to about 15 minutes. In some embodiments, the aqueous foaming cleaning composition for use with the methods of the present invention is applied as stable foam to the surface to be cleaned for about 10 minutes. It is to be understood that any value between these ranges is to be encompassed by the methods of the present invention.

Another object is a foam comprising the components of the liquid foaming cleaning composition.

According to one embodiment, the foam composition, preferably obtained from a diluted liquid foaming cleaning composition, has a foam stability, wherein the reduction of foam volume after 1 minute is about 10 vol.-% to 20 vol.-%, after 2 minute is about 15 vol.-% to 25 vol.-%, after 5 minute is about 30 vol.-% to 40 vol.-% and after 10 minute is about 75 vol.-% to about 85 vol.-%, based on the initial foam volume.

The foam stability allows an improved cleaning effect, because the foam as such can be considered as a carrier for the cleaning solution. It ensures that the solution can also adhere to vertical surface and ceilings. As a result, longer contact is achieved between the cleaning solution and the surface to be cleaned. The foam layer on the cleaning agent film has a repository effect, i.e. through destruction of further foam bubbles new cleaning agent solution is constantly transported to the surface.

The following non-limiting examples illustrate certain advantages of the present invention.

EXAMPLES

Examples E1 to E11 and C1 to C4

The compositions of examples E1 to E11 of the invention and comparative examples C1 to C4 were prepared by mixing the components as mentioned in table I and II below.

A pump—Prominent Elektronik A308—is delivering a 3% solution of the compositions of examples E1 to E11 and C1 to C4, with a rate of 7.5 L/h into a mixing block, wherein the solutions E1 to E11 and C1 to C4 are diluted to a 3% solution with tab water, 15° dH. In the mixing block the diluted composition is mixed with air at about 1.8 bar, 20 l/min and homogenized in a static mixing line with an inner diameter of about 10 mm, 200 mm length, and four blades. After the mixing line the generated foam is delivered through a 80 cm long hose, having an inner diameter of about 10 mm, to a spray nozzle of narrowed pipe type, 60 mm long, inner diameter 6 mm, and sprayed onto a vertical arranged stainless steel surface over a distance of 20 cm. The setup gives a circularly shaped foamed area. With progression of time the foam slides down the stainless steel surface and/or decays. Then the percentage of surface covered by foam in a circular area of a 10 cm radius around the center of the foamed area at that stainless steel surface is measured at about 5 min after application

TABLE I

| Components | E1 | E2 | E3 | E4 | E5 | E6 | E7 | E8 |
|---|---|---|---|---|---|---|---|---|
| Water add. 100 wt.-% | balance water | balance water | balance water | balance water | balance water | balance water | balance water | balance water |
| lauramine oxide | 0.45 | 0.3 | 0.15 | 0.45 | 0.3 | 0.15 | 0.15 | 0.3 |
| Tetradecyldimethyl-amine oxide | 0.25 | 0.375 | 0.5 | 0.25 | 0.375 | 0.5 | 0.5 | 0.375 |
| sodium lauryl sulfate | 1.5 | 1.5 | 1.5 | 0.9 | 0.9 | 0.9 | 0.3 | — |
| lauryl ether carboxylic acid/ myristil ether carboxylic acid | — | — | — | — | — | — | — | 3.68 |
| sodium hydroxide | 5 | 5 | 5 | 5 | 5 | 5 | 5 | 5 |
| cumene sulfonate | 2 | 2 | 2 | 2 | 2 | 2 | 2 | 2 |
| acrylic polymer sodium salt*1 | 0.9 | 0.9 | 0.9 | 0.9 | 0.9 | 0.9 | 0.9 | 0.9 |
| ratio Lauramine oxide/ Tetradecyldimethyl-amine oxide | 1.8 | 0.8 | 0.3 | 1.8 | 0.8 | 0.3 | 0.3 | 0.8 |
| percentage of foam covering the surface*2 | 33 | 62 | 81 | 49 | 71 | 71 | 45 | 33 |

*1= acrylic polymer sodium salt totally Na neutralized with an average molecular weight (Mw) of about 4500.

*2= percentage of surface covered in a circular area of a 10 cm radius around the center of the foamed area at about 5 min after application.

TABLE II

| Components | E9 | E10 | E11 | C1 | C2 | C3 | C4 |
|---|---|---|---|---|---|---|---|
| Water add. 100 wt.-% | balance water | balance water | balance water | balance water | balance water | balance water | balance water |
| lauramine oxide | 0.15 | 0.15 | 0.15 | 0.6 | — | 0.6 | 0.15 |
| tetradecyldimethylamine oxide | 0.5 | 0.5 | 0.5 | — | 0.5 | 0.125 | — |
| sodium lauryl sulfate | — | — | — | 1.5 | 1.5 | — | — |
| lauryl ether carboxylic acid/myristil ether carboxylic acid | 3.68 | 3.68 | 3.68 | — | — | — | 3.68 |
| sodium hydroxide | 5 | 2 | 15 | 5 | 5 | 5 | 5 |
| cumene sulfonate | 2 | 2 | 2 | 2 | 2 | 2 | 2 |
| acrylic polymer sodium salt*1 | 0.9 | 0.9 | 0.9 | 0.9 | 0.9 | 0.9 | 0.9 |
| ratio Lauramine oxide/ Tetradecyldimethylamine oxide | 0.3 | 0.3 | 0.3 | — | — | 4.8 | 4.8 |
| percentage of foam covering the surface*2 | 71 | 69 | 76 | <20 | <20 | <20 | <20 |

*1= acrylic polymer sodium salt totally Na neutralized with an average molecular weight (Mw) of about 4500.

*2= percentage of surface covered in a circular area of a 10 cm radius around the center of the foamed area at about 5 min after application.

Foam Formation

This test method provides a basis to assess the foam properties of the liquid foaming cleaning composition of the invention.

Foam Testing Equipment microscope, Keyence VHX-600 digital microscope, was used at about 23° C. with a magnification of 1:10000;

apparatus to generate foam, Kruess Dynamic Foam Analyzer DFA100, 1 L/min air for about 5 seconds at 20° C., the bottom filter of the glass cuvette has a pore size of 40-100 μm.

The foam was generated with an Krüss Dynamic Foam Analyzer DFA100, whereby in a cuvette of 1005 ml volume with an inner diameter of 40 mm and a bottom comprising a filter of a pore size of 40-100 μm, 50 ml of a 2% with tab water (15° dH) diluted liquid foaming cleaning test composition was placed. The compositions C1 and E3 are used as test compositions. The foam for C1 and E3 was generated in an upright standing arranged glass cuvette by a vertical airflow of 1 L/min for about 5 seconds at 20° C. through the bottom filter having a pore size of 40-100 μm to the top end of said cuvette.

The foam formation was 10× times repeated and for each of the generated foam the foam diameter pore size was determined in order to calculate a mean value.

The mean foam diameter pore size was determined with a Keyence VHX-600 digital microscope at about 23° C. with a magnification of 1:10000. The results are shown in Table III.

TABLE III

| Mean foam diameter pore size | | |
|---|---|---|
| | C1 | E3 |
| Mean value (μm) | 181 | 142 |
| Standard deviation | 91 | 41 |
| 25% foam pores below | 127 | 114 |
| 50% foam pores below | 179 | 160 |
| 75% foam pores below | 269 | 180 |

The results of table III clearly shows that the mean foam diameter pore size of the foam obtained from a liquid foaming cleaning composition E3 according to the invention is smaller and generates a very much smaller average foam pore size deviation value compared with the comparative foam C1. It is assumed that the improved cleaning performance of the liquid foaming cleaning composition according to the invention is based on the foam pore size and foam stability.

TABLE IV

| Foam stability | | |
|---|---|---|
| t/s | C1 Vol.-% | E3 Vol.-% |
| 5 | 100 | 100 |
| 100 | 76 | 82 |
| 200 | 75 | 79 |
| 400 | 71 | 78 |
| 600 | 67 | 77 |
| 800 | 58 | 76 |
| 1000 | 47 | 75 |
| 1200 | 41 | 74 |

The foam for determining the foam stability was generated with an Krüss Dynamic Foam Analyzer DFA100, whereby in a cuvette of 1005 ml volume with an inner diameter of 40 mm and a bottom comprising a filter of a pore size of 40-100 μm, 50 ml of a 2% with tab water (15° dH) diluted liquid foaming cleaning test composition was placed. The compositions C1 and E3 are used as test compositions. The foam for C1 and E3 was generated in an upright standing arranged glass cuvette by a vertical airflow of 1 L/min for about 5 seconds at 20° C. through the bottom filter having a pore size of 40-100 μm to the top end of this cuvette. Thereafter the foam generation was stop and the reduction of foam volume for the foam of E3 and C1 was determined.

Table IV clearly demonstrate that the foam obtained from a liquid foaming cleaning composition E3 according to the invention has a significant increased long lasting performance compared with the comparative composition C1.

Cleaning Efficiency Test Method

This test method provides a basis to assess the foam compositions according to the invention for cleaning efficiency of Ceramic test plate surfaces contaminated with mixed tallow/lard soils.

Equipment

Prominent Elektronik A308

800 ml beaker

Acetone

Colored mixed tallow/lard (soil; colorant Sudan IV (1 g/Kg soil))

Spattle

Ceramic test plates of 24 cm×12 cm×0.5 cm (Ceramic test plates are cleaned with acetone before use)

Clean paper toweling

Stop watch

Camera.

The ceramic test plates were cleaned before use with acetone, cleaned thereafter with a clean paper toweling and allowed to dry at room temperature for about 12 hours. The upper surface of said ceramic test plates were homogenously coated with tallow/Lard test soil to form a 1.5 cm brought stripe of soil, leaving the upper 3.5 cm of the test plate uncoated. The coated test plates were foamed using the Prominent Elektronik A308 under identical conditions as described above for examples E1 to E11 and C1 to C4, with a 3% solution of the compositions E3 and C1, wherein the compositions E3 and C1 are diluted to a 3% solution with tab water of 15° dH, at about 40° C. After 20 minutes the so treated ceramic test plate were rinsed with 600 ml allowed to dry at ambient temperature at about 23° C. for 15 hours. After that, photos were taken from the test plates and the solid surface area after cleaning and rinsing was compared to the soiled surface area before cleaning and rinsing.

The C1 cleaning composition provides a tallow removal of about 68% where else the E3 cleaning composition of the present invention provides a tallow removal of about 93%. Thus, the cleaning efficiency test clearly demonstrates that the cleaning composition E3 according to the present invention has a significant improved cleaning performance.

It is to be understood that wherever values and ranges are provided herein, all values and ranges encompassed by these values and ranges, are meant to be encompassed within the scope of the present invention. Moreover, all values that fall within these ranges, as well as the upper or lower limits of a range of values, are also contemplated by the present application.

We claim:

1. An aqueous foaming cleaning composition for removing soil at low temperatures from a surface to be cleaned comprising:

from about 0.1 to about 10 wt. % of a mixture of (1) a $C_{12}$ amine oxide component comprising at least one of a linear and/or branched $C_{12}$-alkyl dimethylamine oxide, $C_{12}$-alkyl diethylamine oxide, or $C_{12}$-alkyl methylethylamine oxide; and (2)

a $C_{14}$ amine oxide component comprising at least one of a linear and/or branched $C_{14}$-alkyl dimethylamine oxide, $C_{14}$-alkyl diethylamine oxide, or $C_{14}$-alkyl methylethylamine oxide;

from about 0.1 to about 10 wt. % of a dodecyl $(oxyethylen)_w$ sulfate, wherein w represents an average addition mole number ranging from about 1 to about 10;

from about 0.1 to about 10 wt. % of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to about 18 carbon atoms;

AO represents an alkylene oxy group having about 2 to about 4 carbon atoms;

n represents an average addition mole number ranging from about 1 to about 20;

A' represents an alkylene group having about 1 to about 3 carbon atoms;

M represents H or a cation; and m represents the number equal to a valence number of M;

from about 0.5 to about 10 wt. % of a source of alkalinity;

from about 1 to about 5 wt. % of a hydrotrope;

from about 0.5 to about 2 wt. % of a polycarboxylate; and at least 45 wt. % water.

2. The composition according to claim 1, wherein the weight-% ratio of the $C_{12}$ amine oxide component to the $C_{14}$ amine oxide component is about 10:1 to about 1:10, whereby the weight-% is based on the total weight of the composition.

3. The composition according to claim 1, comprising lauryl dimethyl amine oxide, tetradecyl dimethyl amine oxide;

an anionic surfactant comprising:

a dodecyl $(oxyethylen)_w$ sulfate, wherein w represents an average addition mole number ranging from about 1 to about 10, preferably about 2 to about 8 and more preferred about 3 to about 5, and at least one polyoxyalkylene alkyl ether carboxylic acid or salt thereof represented by formula (I), wherein, R represents a linear and/or branched alkyl group having about 10 to about 16 carbon atoms;

AO represents an alkylene oxy group having 2 to about 3 carbon atoms;

n represents an average addition mole number ranging from 2 to about 10;

A' represents an alkylene group having about 1 to 2 carbon atoms;

M represents H or a cation; and m represents the number equal to a valence number of M.

4. The composition according to claim 1, wherein the weight-% ratio a) of the total amount of amine oxides to b) the total amount of anionic surfactant are in the range of about 1:4 to about 1:0.2, whereby the weight-% is based on the total weight of the composition.

5. The composition according to claim 1, wherein the source of alkalinity is selected from the group comprising alkali metal hydroxides, alkali metal salts, phosphates, amines, and mixtures thereof.

6. The composition according to claim 1, wherein the hydrotrope comprises cumene sulfonate.

7. The composition according to claim 1 wherein the polycarboxylate has a molecular weight of about 500 Mw to about 50000 Mw based on a totally neutralized sodium polymeric polycarboxylate.

8. The aqueous foaming cleaning composition according to claim 1, wherein the aqueous foaming cleaning composition has a pH in the range of about 7.0 to about 14.0.

9. The composition of claim 1 having a foam stability, wherein the reduction of foam volume after 1 minute is about 10 vol.-% to 20 vol.-%, based on the initial foam volume.

10. The composition of claim 1 having a mean foam diameter pore size $D_{50}$ in the range of ≥10 μm to about ≤2000 μm.

11. A method for removing soil from a surface to be cleaned comprising applying to the surface a composition comprising:

from about 0.1 to about 10 wt. % of a mixture of (1) a $C_{12}$ amine oxide component comprising at least one of a linear and/or branched $C_{12}$-alkyl dimethylamine oxide, C12-alkyl diethylamine oxide, or $C_{12}$-alkyl methylethylamine oxide; and (2) a $C_{14}$ amine oxide component comprising at least one of a linear and/or branched $C_{14}$-alkyl dimethylamine oxide, $C_{14}$-alkyl diethylamine oxide, or $C_{14}$-alkyl methylethylamine oxide;

from about 0.1 to about 10 wt. % of a dodecyl $(oxyethylen)_w$ sulfate, wherein w represents an average addition mole number ranging from about 1 to about 10;

from about 0.1 to about 10 wt. % of at least one polyoxyalkylene alkyl ether carboxylic acid or salt thereof represented by formula (I):

$$RO\text{-}(AO)_{n-1}\text{-}A'\text{-}COO_mM \quad (I)$$

wherein,

R represents a linear and/or branched alkyl group having about 8 to about 18 carbon atoms;

AO represents an alkylene oxy group having about 2 to about 4 carbon atoms;

n represents an average addition mole number ranging from about 1 to about 20;

A' represents an alkylene group having about 1 to about 3 carbon atoms;

M represents H or a cation; and m represents the number equal to a valence number of M;

from about 0.5 to about 10 wt. % of a source of alkalinity;

from about 1 to about 5 wt. % of a hydrotrope;

from about 0.5 to about 2 wt. % of a polycarboxylate; and at least 45 wt. % water.

12. The method of claim 11 comprising:

a) optional applying a pre-treatment solution, preferably water, to the surface to be cleaned for an amount of time sufficient to substantially penetrate a soil on the surface to be cleaned and/or pre-clean a soil on the surface to be cleaned;

b) applying the composition to the surface to be cleaned for an amount of time for cleaning the surface to be cleaned;

c) optional a rinsing step before and/or after the application (a) and/or (b).

13. The method of claim 11, wherein, the soil is removed from a surface using a clean-out-of-place system.

* * * * *